US010054060B2

(12) United States Patent
Askerlund

(10) Patent No.: US 10,054,060 B2
(45) Date of Patent: Aug. 21, 2018

(54) ADJUSTABLE FUEL PLATE FOR DIESEL ENGINE FUEL PUMP

(71) Applicant: Attitude Performance Products, LLC, Sandy, UT (US)

(72) Inventor: Justin Askerlund, Bluffdale, UT (US)

(73) Assignee: Attitude Performance Products, LLC, Sandy, UT (US)

( * ) Notice: Subject to any disclaimer, the term of this patent is extended or adjusted under 35 U.S.C. 154(b) by 0 days.

(21) Appl. No.: 15/393,549

(22) Filed: Dec. 29, 2016

(65) Prior Publication Data

US 2017/0234242 A1 Aug. 17, 2017

Related U.S. Application Data

(63) Continuation of application No. 14/741,612, filed on Jun. 17, 2015.

(60) Provisional application No. 62/135,881, filed on Mar. 20, 2015.

(51) Int. Cl.

| | |
|---|---|
| ***F02D 1/12*** | (2006.01) |
| ***F02D 1/14*** | (2006.01) |
| ***F02D 1/10*** | (2006.01) |
| ***F02M 59/44*** | (2006.01) |
| ***F02M 59/48*** | (2006.01) |
| *F02D 1/00* | (2006.01) |

(52) U.S. Cl.

CPC ..... *F02D 1/127* (2013.01); *F02D 1/10* (2013.01); *F02D 1/14* (2013.01); *F02M 59/447* (2013.01); *F02M 59/48* (2013.01); *F02D 2001/006* (2013.01); *F02D 2001/007* (2013.01); *F02D 2001/0045* (2013.01)

(58) Field of Classification Search

CPC ..... F02D 1/10; F02D 1/12; F02D 1/14; F02D 1/127; F02D 2001/007; F02D 2700/0215

USPC ..... 123/357–400

See application file for complete search history.

(56) References Cited

U.S. PATENT DOCUMENTS 4,212,279 A * 7/1980 Ohtani ..... F02D 1/08 123/357
4,286,559 A * 9/1981 Ritter ..... F02M 59/447 123/380
4,355,610 A * 10/1982 Parks ..... F02D 1/045 123/386
4,389,991 A * 6/1983 Gibson ..... F02D 1/12 123/364
4,523,564 A * 6/1985 Sturdy ..... B60K 31/047 123/352

(Continued)

OTHER PUBLICATIONS

12 Valve Adjustable Fuel Plate Kit, http://www.scheiddiesel.com/scheid-lightning/12-valve-adjustable . . . , accessed Sep. 21, 2016, 3 pages.

*Primary Examiner* — John Kwon
*Assistant Examiner* — Johnny H Hoang
(74) *Attorney, Agent, or Firm* — Thorpe North & Western, LLP

(57) ABSTRACT

An adjustable fuel plate device for a diesel fuel pump is disclosed. The adjustable fuel plate device can include a fuel plate to limit travel of a governor arm of a diesel fuel pump for a diesel engine. The adjustable fuel plate device can also include a translation mechanism to move the fuel plate relative to the governor arm. Additionally, the adjustable fuel plate device can include a control system coupleable to the translation mechanism to control movement of the fuel plate during operation of the engine.

21 Claims, 7 Drawing Sheets

(56) References Cited

U.S. PATENT DOCUMENTS

| | | | | |
|---|---|---|---|---|
| 4,640,247 | A * | 2/1987 | Bruning | F02D 1/065<br>123/366 |
| 5,279,270 | A * | 1/1994 | Ichikawa | F02D 9/02<br>123/336 |
| 6,431,143 | B1 * | 8/2002 | Pratt | F02D 1/065<br>123/179.17 |
| 7,728,472 | B2 * | 6/2010 | Huck | H02K 5/225<br>310/68 R |
| 2006/0048750 | A1 * | 3/2006 | Tanaka | F02D 1/10<br>123/357 |
| 2009/0314240 | A1 * | 12/2009 | Maupin | F02M 1/02<br>123/179.11 |

* cited by examiner

ADJUSTABLE FUEL PLATE FOR DIESEL ENGINE FUEL PUMP

RELATED APPLICATION

This application is a continuation application of U.S. patent application Ser. No. 14/741,612, filed on Jun. 17, 2015, which claims the benefit of U.S. Provisional Application No. 62/135,881, filed Mar. 20, 2015, each of which is incorporated herein by reference.

BACKGROUND

Diesel engines have been in widespread use for many decades. BOSCH® P series fuel injection pumps (e.g., P-7100, P-8500, etc., commonly known as "P pumps") have been utilized by a variety of engine manufacturers over the years for use in a wide range of vehicles and equipment (e.g., automotive, industrial, agricultural, marine, power generation, etc.). These fuel pumps have a reputation for durability and can be tunable for high performance. One common performance enhancement is to modify a fuel plate (also known as a fuel stop plate or a cam plate) of the fuel pump, which affects the amount of fuel the pump can deliver at a given engine speed by providing a mechanical limit or stop. Thus, modifying a "profile" of the fuel plate can have a dramatic effect on performance.

BRIEF DESCRIPTION OF DRAWINGS

In accordance with examples of the present disclosure, the following is a brief description of the accompanying drawings.

DETAILED DESCRIPTION

Figure 1:
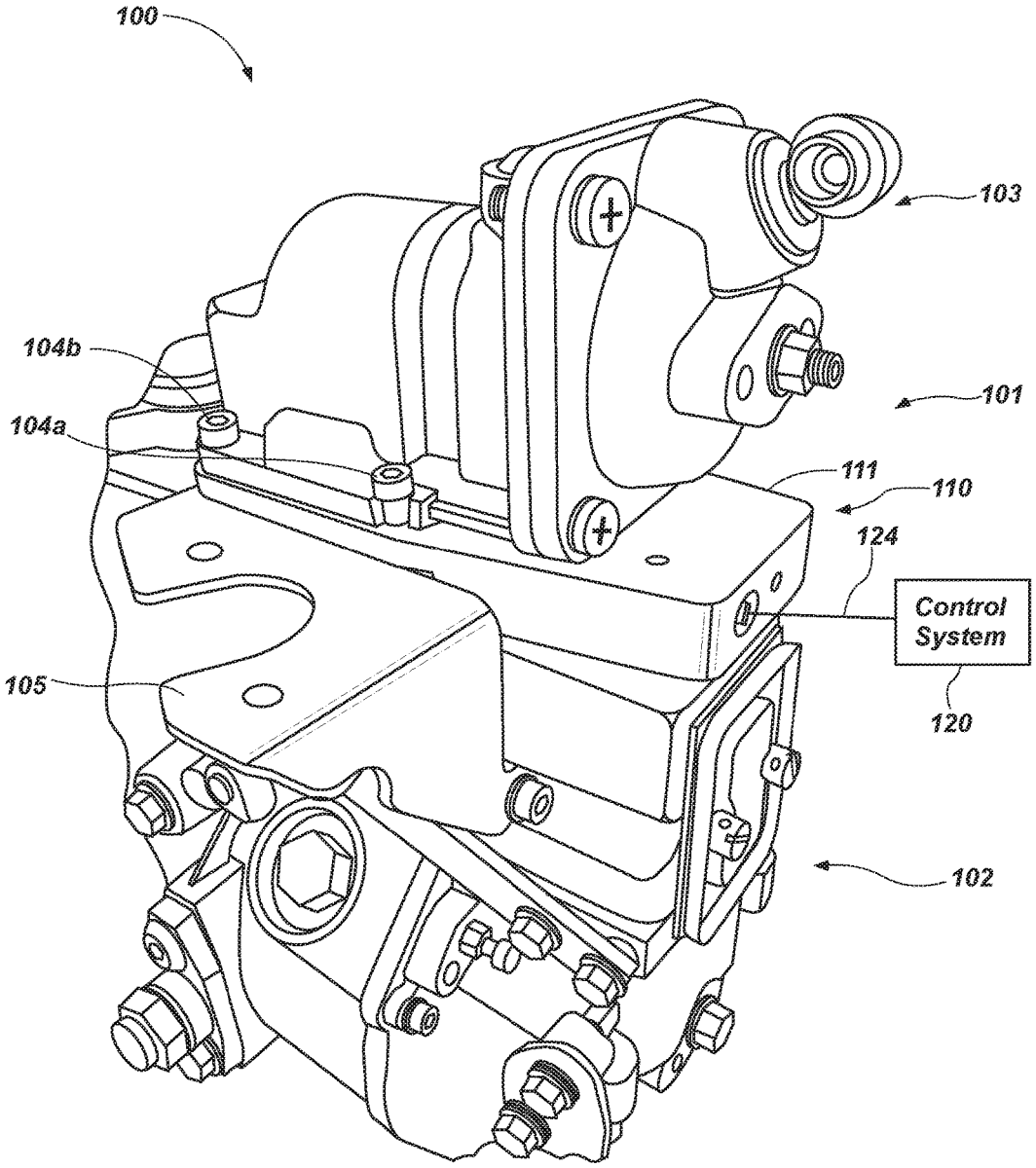
FIG. 1 illustrates a diesel fuel pump system in accordance with an example of the present disclosure.

Reference will now be made to the exemplary embodiments, and specific language will be used herein to describe the same. It will nevertheless be understood that no limitation of the scope of the disclosure is thereby intended. Alterations and further modifications of the inventive features illustrated herein, and additional applications of the principles of the technology as illustrated herein, which would occur to one skilled in the relevant art and having possession of this disclosure, are to be considered within the scope of the disclosure. It is also to be understood that the terminology used herein is used for the purpose of describing particular embodiments only. The terms are not intended to be limiting unless specified as such.

It must be noted that, as used in this specification and the appended claims, the singular forms "a," "an," and "the" include plural referents unless the content clearly dictates otherwise.

In describing embodiments of the present disclosure, reference will be made to "first" or "second" as they relate to spacer threaded portions, for example. It is noted that these are merely relative terms, and a spacer threaded portion described or shown as a "first" threaded portion could just as easily be referred to a "second" threaded portion, and such description is implicitly included herein.

Dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of about 1 wt % and about 20 wt %, but also to include individual weights such as 2 wt %, 11 wt %, 14 wt %, and sub-ranges such as 10 wt % to 20 wt %, 5 wt % to 15 wt %, etc.

In accordance with these definitions and embodiments of the present disclosure, a discussion of the various systems and methods is provided including details associated therewith. This being said, it should be noted that various embodiments will be discussed as they relate to the systems and methods. Regardless of the context of the specific details as they are discussed for any one of these embodiments, it is understood that such discussion relates to all other embodiments as well.

Reference throughout this specification to "one embodiment," "an embodiment," "one example," or "an example" means that a particular feature, structure, or characteristic described in connection with the embodiment is included in at least one example of the present disclosure. Thus, appearances of the phrases "in one embodiment" or "in one example" in various places throughout this specification are not necessarily all referring to the same embodiment or example.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present disclosure may be referred to herein along with alternatives for the various components thereof. It is understood that such embodiments, examples, and alternatives are not to be construed as de facto equivalents of one another, but are to be considered as separate and autonomous representations of the present disclosure.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the disclosure. One skilled in the relevant art will recognize, however, that the present technology can be practiced without one or more of the specific details, or with other methods, components, materials, etc. In other instances, well-known structures, materials, or operations are not shown or described in detail to avoid obscuring aspects of the disclosure.

In accordance with these definitions and embodiments of the present disclosure, a discussion of the various systems and methods is provided including details associated therewith. This being said, it should be noted that various embodiments will be discussed as they relate to the systems and methods. Regardless of the context of the specific details as they are discussed for any one of these embodiments, it is understood that such discussion relates to all other embodiments as well.

Although the typical fuel plate modification is effective to improve performance, one drawback of BOSCH® P Series fuel injection pumps when compared to some other fuel injection pumps (i.e., electronically controlled pumps) is the inability to vary the available engine power dynamically while the engine is operating, because fuel plates having different profiles are exchanged when the fuel pump is at least partially disassembled and the installed fuel plate is secured at a fixed position.

Accordingly, the present disclosure is drawn to an adjustable fuel plate device for a diesel fuel pump. In one aspect, the adjustable fuel plate device can vary the power available from the engine while the engine is operating. The adjustable fuel plate device can include a fuel plate to limit travel of a governor arm of a diesel fuel pump for a diesel engine; a translation mechanism to move the fuel plate relative to the governor arm; and a control system coupleable to the translation mechanism to control movement of the fuel plate during operation of the engine.

In another example, an adjustable fuel plate assembly for a diesel fuel pump can include a support member having an opening; a fuel plate disposed at least partially in the opening to limit travel of a governor arm of a diesel fuel pump for a diesel engine; and a translation mechanism to move the fuel plate relative to the governor arm. In this example, the opening can be configured to receive an aneroid fuel control (AFC) arm therethrough and facilitate operation of an AFC with the diesel fuel pump.

In another example, an adjustable fuel plate kit for modifying a diesel fuel pump can include an adjustable fuel plate assembly to be disposed between a diesel fuel pump for a diesel engine and an aneroid fuel control (AFC). The adjustable fuel plate assembly can include a support member having an opening, a fuel plate disposed at least partially in the opening to limit travel of a governor arm of the diesel fuel pump, and a translation mechanism to move the fuel plate relative to the governor arm. The adjustable fuel plate kit can further include a control system coupleable to the translation mechanism to control movement of the fuel plate during operation of the engine, and a replacement AFC arm to replace an original AFC arm of the AFC. The opening of the support member can be configured to receive the AFC arm therethrough and the replacement AFC arm is configured to extend into the diesel fuel pump to facilitate operation of the AFC with the diesel fuel pump.

In another example, a diesel fuel pump system can include a diesel fuel pump for a diesel engine; an aneroid fuel control (AFC); and an adjustable fuel plate device disposed between the diesel fuel pump and the AFC. The adjustable fuel plate device can include a fuel plate to limit travel of a governor arm of the diesel fuel pump, a translation mechanism to move the fuel plate relative to the governor arm, and a control system coupled to the translation mechanism to control movement of the fuel plate during operation of the engine.

In another example, a method for facilitating adjustment of a fuel plate of a diesel fuel pump can include providing an adjustable fuel plate assembly to be disposed between a diesel fuel pump for a diesel engine and an aneroid fuel control (AFC); and facilitating operation of the AFC with the diesel fuel pump. The adjustable fuel plate assembly can include a support member having an opening, a fuel plate disposed at least partially in the opening to limit travel of a governor arm of the diesel fuel pump, and a translation mechanism to move the fuel plate relative to the governor arm.

In another example, a method for modulating fuel conservation of a diesel engine during operation of the engine can include providing a translation mechanism to move a fuel plate of a diesel fuel pump relative to a governor arm of the fuel pump, the fuel plate being configured to limit travel of the governor arm; and facilitating operation of the translation mechanism during operation of the engine, wherein the translation mechanism is operable to move the fuel plate from a first position to a second position, thereby altering the fuel consumption of the diesel engine. In one example, the second position can be more limiting of governor arm movement than the first position, thereby providing improved fuel efficiency. In another example, the first position can be more limiting of governor arm movement than the second position, thereby providing improved diesel engine performance.

In another example, a method for modulating fuel consumption of a diesel engine during operation of the engine can include providing a control system to variably limit travel of a governor arm of a diesel fuel pump; and facilitating control of the governor arm travel by the control system during operation of the diesel engine, wherein a travel limit of the governor arm is changed from a first limit position to a second limit position, thereby altering the fuel consumption. In one example, the second limit position can be more limiting of governor arm movement than the first limit position, thereby providing improved fuel efficiency. In another example, the first limit position can be more limiting of governor arm movement than the second limit position, thereby providing improved performance. In one aspect, the method can further comprise facilitating operation of the control system by a driver of a vehicle that includes the diesel engine. In another aspect, the method can further comprise providing a translation mechanism to move a fuel plate of the diesel fuel pump relative to the governor arm, the fuel plate being configured to limit travel of the governor arm, wherein facilitating control of the governor arm travel by the control system comprises facilitating control of the translation mechanism by the control system to move the fuel plate from the first limit position to the second limit position.

Other embodiments are also disclosed herein including various combinations of the above-identified examples. As such, reference will now be made to various exemplary embodiments, and specific language will be used herein to describe the same. It will nevertheless be understood that no limitation of the scope of the disclosure is thereby intended. Alterations and further modifications of the inventive features illustrated herein, and additional applications of the principles of the disclosure as illustrated herein, which would occur to one skilled in the relevant art and having possession of this disclosure, are to be considered within the scope of the disclosure. It is also to be understood that the terminology used herein is used for the purpose of describing particular embodiments only. The terms are not intended to be limiting unless specified as such.

Turning now more specifically to FIG. 1, this FIG. illustrates a diesel fuel pump system 100, in accordance with an example of the present disclosure. In general, the diesel fuel pump system 100 can include a diesel fuel pump 102 for a diesel engine, an aneroid fuel control (AFC) 103, and an adjustable fuel plate device 101 for the diesel fuel pump 102. At least a portion of the adjustable fuel plate device 101 can be disposed between the diesel fuel pump 102 and the AFC 103, as shown in the figure. For example, in the embodiment shown, the adjustable fuel plate device 101 can include a control system 120 and an adjustable fuel plate assembly 110. The adjustable fuel plate assembly is shown disposed between the diesel fuel pump 102 and the AFC 103.

In some embodiments, the adjustable fuel plate device 101 can include a fuel plate and a translation mechanism as part of the adjustable fuel plate assembly 110, which are obscured from view in FIG. 1, and a control system 120 coupled to the translation mechanism to control movement and/or position of the fuel plate during operation of the engine and the fuel pump 102. As described in more detail hereinafter, the fuel plate can limit travel of a governor arm of the diesel fuel pump 102, and the translation mechanism can move the fuel plate relative to the governor arm.

Figure 2A:
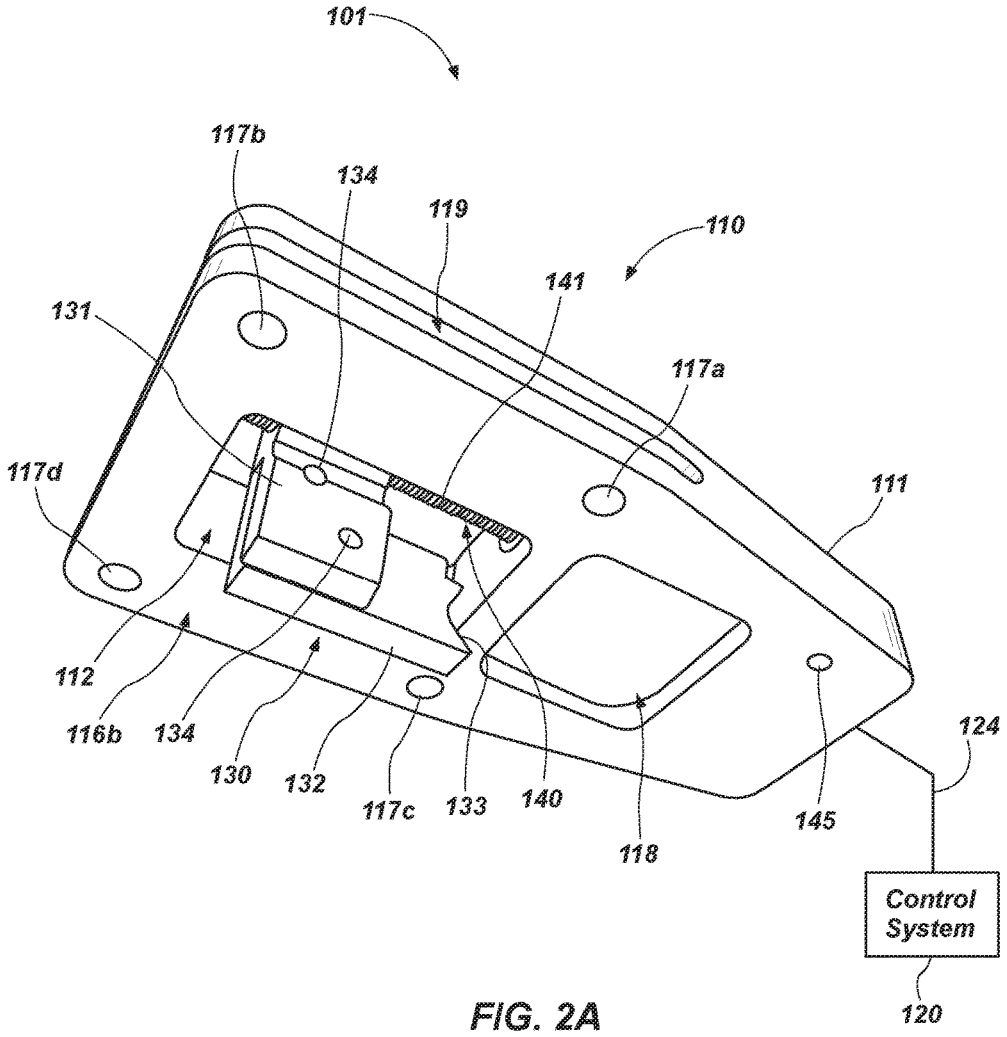
FIGS. 2A and 2B are bottom perspective views of an adjustable fuel plate device of the diesel fuel pump system of FIG. 1.
Figure 2B:
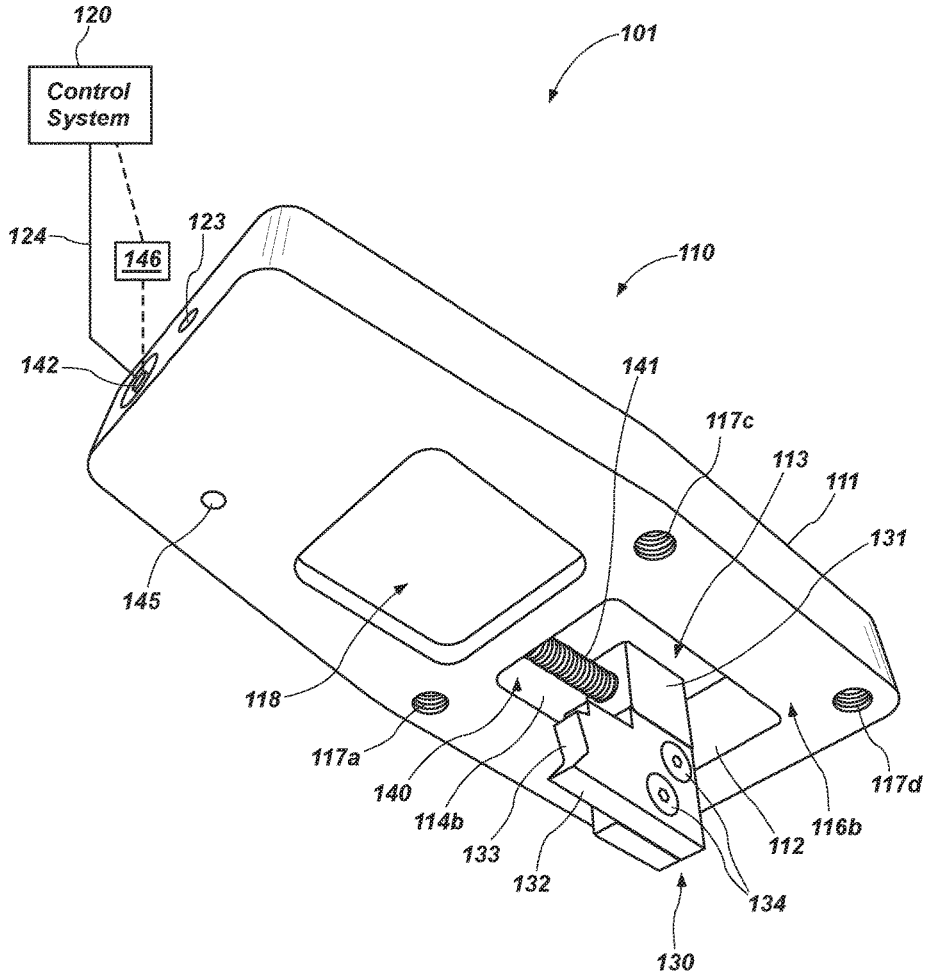
Figure 3:
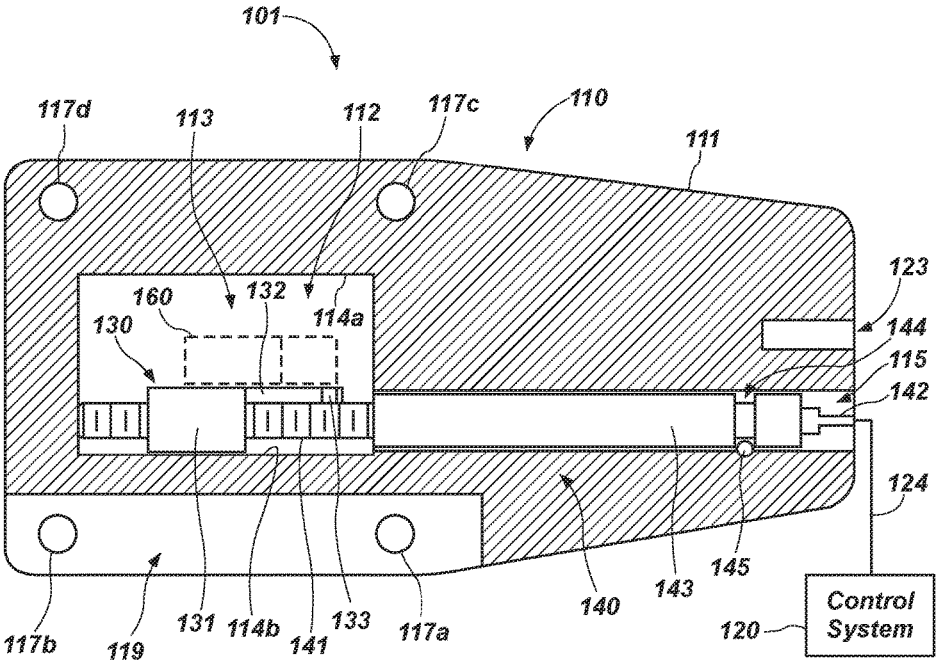
FIG. 3 is a top cross-sectional view the adjustable fuel plate device of the diesel fuel pump system of FIG. 1.
Figure 4:
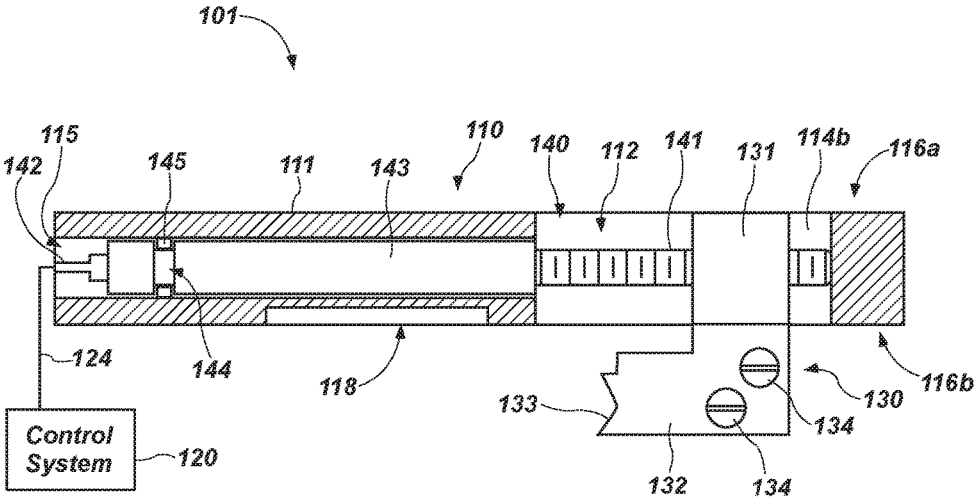
FIG. 4 is a side cross-sectional view the adjustable fuel plate device of the diesel fuel pump system of FIG. 1.

With continued reference to FIG. 1, and as shown more specifically in FIGS. 2A-B, 3, and 4, the adjustable fuel plate device 101 is shown isolated from other components of the system 100 to show features that are obscured when the system is assembled as illustrated in FIG. 1. In particular, FIGS. 2A and 2B illustrate bottom perspective views of the adjustable fuel plate device 101, and FIGS. 3 and 4 illustrate top and side cross-sectional views, respectively, of the adjustable fuel plate device 101.

As previously noted, the adjustable fuel plate device 101 includes both the adjustable fuel plate assembly 110 and the control system 120, i.e., control knobs, gears, cable controller, etc. The adjustable fuel plate assembly specifically can include a support member 111, which can be configured to interface with the fuel pump 102 (i.e., a fuel pump housing) and the AFC 103 (i.e., an AFC housing). For example, top and bottom sides 116*a*, 116*b* of the support member 111 can be configured to interface with portions of the AFC 103 and the fuel pump 102, respectively. The support member 111 can also include coupling features 117*a-d*, such as holes, to facilitate coupling the AFC 103, the adjustable fuel plate device 101, and the fuel pump 102 to one another, such as with bolts 104*a*, 104*b* or other fasteners, pins, clips, etc. (FIG. 1). The support member 111 can include any number of such coupling features 117*a-d*, which may be of any suitable configuration to facilitate coupling the AFC 103, the adjustable fuel plate device 101, and/or the fuel pump 102 to one another. The support member 111 can also include any suitable feature, such as a recess 118, to facilitate proper mating or interfacing of the support member 111 with adjacent components. The recess 118 can be of any suitable shape or configuration. In this case, the recess 118 is configured to accommodate a protrusion from a housing of the fuel pump 102 (see FIG. 6). In addition, the support member 111 can have an opening 119, such as a slot, channel, groove, etc., configured to receive a portion of a bracket 105 (e.g., a bracket to support a shutoff solenoid) that may be coupled to the fuel pump 102. The opening 119 can be of any suitable shape or configuration. In this case, the holes 117*a*, 117*b* can extend through the slot 119 such that the bolts 104*a*, 104*b* can secure the bracket 105 to the adjustable fuel plate assembly 110, as well as securing the AFC 103 to the top of adjustable fuel plate assembly 110 and the adjustable fuel plate assembly 110 to the top of the fuel pump 102. Thus, the adjustable fuel plate assembly 110 can be configured to facilitate installation or retrofitting to the fuel pump 102 without the need for any structural modifications to the fuel pump 102, the AFC 103, or other associated parts that may be attached these components. Installation of the adjustable fuel plate assembly 110 can therefore be a "drop-in" modification that can be executed using common tools and without the need for any alteration of existing parts. The support member 111 can be constructed in any suitable manner in accordance with the principles disclosed herein.

As shown in FIGS. 2A-B, 3, and 4, the support member 111 of the adjustable fuel plate assembly 110 can have an opening 112 that extends through the support member. The assembly 110 can also include a fuel plate 130 disposed at least partially in the opening 112. Additionally, the assembly 110 can include a translation mechanism 140 to move the fuel plate 130. The opening 112 can be configured to receive an AFC arm 160 (FIG. 3 shown in phantom lines) through the opening, such as in a gap or space 113 between the fuel plate 130 and a sidewall 114*a* of the opening 112, to facilitate operation of the AFC 103 with the diesel fuel pump 102. Thus, the AFC 103 can be fully operational with the diesel fuel pump 102 during operation of the engine and the fuel pump.

The translation mechanism 140 can include a lead screw 141 to provide and/or facilitate movement of the fuel plate 130, which can be analogous to a "traveling nut." In one aspect, the support member 111 can provide support for the translation mechanism 140. For example, the support member 111 can be configured to house and/or support at least a portion of the lead screw 141, such as by facilitating rotation of the lead screw 141 relative to the support member 111. Facilitation of relative rotational movement of the lead screw 141 and the support member 111 can be accomplished in any suitable manner, such as using bearings, bushings, etc.

In one aspect, shown in FIGS. 3 and 4, the support member 111 and the lead screw 141 can be configured to interface directly with one another, thus providing a bearingless design, with the lead screw having a bearing portion 143 rotatable within a lead screw opening 115 of the support member 111. A lubricant, such as grease or oil, can be used to reduce friction between relatively moving components, as desired. The lead screw 141 can include a groove or channel 144 configured to receive a pin 145 to secure the lead screw within the lead screw opening 115.

Although the translation mechanism 140 is shown as having a lead screw to provide translation of the fuel plate (which can form a type of linear actuator), it should be recognized that any suitable translation mechanism known in the art may be used to provide and/or facilitate translation of the fuel plate in accordance with the present disclosure. Examples of such mechanisms include a rotational to linear motion mechanism (e.g., a crank and slider), a linear actuator (e.g., a lead screw and traveling nut, a hydraulic or pneumatic ram or cylinder, a cam actuator, a wedge actuator, etc.), a multi-bar linkage mechanism (e.g., a Watt's linkage, a Chebyshev linkage, a Hoekens linkage, a Peaucellier-Lipkin linkage, a Sarrus linkage, etc.), a chain, belt, and/or gear drive train, etc. An element or component of the translation mechanism 140 can be caused to move or actuated by any suitable means, such as by a user (i.e., non-powered), and/or a mechanical, electrical, or electromechanical device or mechanism (i.e., powered). Examples of such powered devices or mechanisms include a motor (e.g., a stepper motor), a linear actuator, a rotary actuator (e.g., an electric motor), etc. Thus, the translation mechanism 140 can optionally include any suitable motor or actuator (see 146 in FIG. 2B) to power the movement or operation of the translation mechanism. In this case, the control system 120 can be operably coupled to such a motor or actuator to control the movement and/or the position of the fuel plate 130, as mentioned above.

The control system 120 can control the movement and/or the position of the fuel plate 130 utilizing any suitable device or mechanism known in the art, such as mechanical, electrical, electromechanical devices and mechanisms. In one aspect, the control system 120 can include a user interface, such as a dial, lever, button, knob, switch, keypad, keyboard, touchscreen, etc., to facilitate control of the position and/or movement of the fuel plate 130 by a user. The control system 120 can be coupled 124 to the translation mechanism 140 in any suitable manner, such as by mechanical, electrical, and/or electromechanical devices and mechanisms, to facilitate movement of the fuel plate 130 during operation of the engine and the fuel pump 102. In one example, a coupling feature 123, such as an opening or hole, can be used to facilitate coupling or securing the control system 120 to the translation mechanism 140. The support member 111 can include any number of such coupling features 123, which may be of any suitable configuration to facilitate coupling or securing the control system 120 to the translation mechanism 140. In another example, the control mechanism 120 can be wired and/or wirelessly coupled to the translation mechanism 140. Accordingly, the coupling 124 can include any suitable transmitter, receiver, etc. to facilitate coupling the control mechanism and the translation mechanism to one another. In one aspect, a position sensor (not shown) can be included to identify a position of the fuel plate 130 during operation. This position can be communicated to the control system to facilitate control of the fuel plate's position by a user. In one aspect, the control system can include a processor to interpret user commands and control operation of the translation mechanism accordingly. Various operational aspects of the device 101 can be communicated to the user (e.g., the fuel plate's position, movement of the fuel plate to a new position, the fuel plate located at a range of motion limit, etc.) visually (e.g., a display), audibly (e.g., a tone), and/or haptically (e.g., a vibration or click feel), etc.

Figure 5:
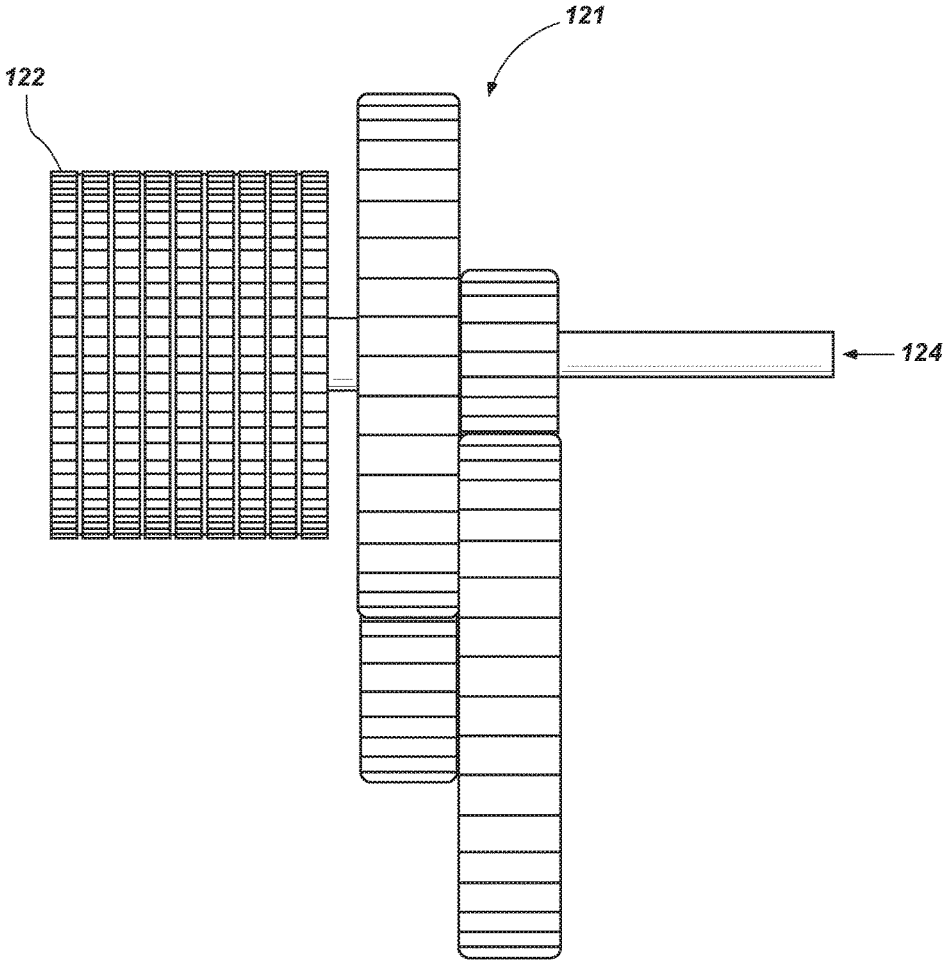
FIG. 5 illustrates a dial and a gear mechanism of a control system of an adjustable fuel plate device in accordance with an example of the present disclosure.

In one aspect, the control system 120 can include only mechanical components, such as a control cable and/or a gear mechanism. For example, the user interface can include a dial or knob, which can be turned by a user. The torque provided by the user can be transferred to the translation mechanism 140 via a cable, which can be coupled to an end 142 of the lead screw 141, for example. The end 142 of the lead screw can be of any suitable shape or configuration to facilitate interfacing and/or coupling with the control system 120. In one aspect, the control system 120 can include a gear mechanism 121 (FIG. 5), which can be used to calibrate revolution of the dial or knob 122 with a distance traveled by, and/or a position of, the fuel plate 130. A cable can be present to connect or couple 124 the gear mechanism with the adjustable fuel plate assembly (not shown in FIG. 5, but shown in FIGS. 1-4) to cause adjustment, in this example. For example, the gear mechanism 121 can be configured such that one revolution or less of the dial or knob 122 causes the cable to rotate and thus, cause the fuel plate 130 to move through its entire range of travel, which may correspond to an entire range of travel of a rack of the fuel pump 102. Alternatively, the dial can be configured so that the entire range of travel occurs in less than one revolution. Still further, the dial or knob can be configured so that the entire range of travel occurs with more than one revolution. Still further, the dial or knob can be configured so that the entire range of travel is less than a full distance possible for travel. In other words, the system can be set up as desired, and calibrated accordingly. Such calibration can also account for a lead, thread pitch, thread count per length, number of threads, etc. of the lead screw 141. Thus, in one aspect, a thread count of 20 threads per inch with a single thread can be paired with a gear mechanism having a ratio of 11:1 to achieve a full range of travel in a single revolution of a dial or knob. In another aspect, a thread count of 16 threads per inch with a single thread can be paired with a gear mechanism having a ratio of 16:1 to achieve a full range of travel in a single revolution of a dial or knob.

The fuel plate 130 can have a base portion 131, which can be configured to interface with and/or form a part of the translation mechanism 140. For example, the base portion 131 of the fuel plate 130 can include threads configured to interface with the lead screw 141. In one aspect, a feature of the support member 111, such as a wall 114*b* defining the opening 112, and the base portion 131 can be configured to interface with one another to prevent rotation of the fuel plate 130 upon rotation of the lead screw 141. Thus, the base portion 131 can be configured to slide along the wall 114*b* as the fuel plate 130 translates under the influence of the lead screw 141. In addition, the fuel plate 130 can include a governor arm interface portion 132 that includes a governor interface surface or feature 133 configured to interface with the governor arm of the fuel pump 102, which defines a profile that can affect the performance of the fuel pump, as described in more detail hereinafter. In one aspect, the governor arm interface portion 132 can be removable from the base portion 131, such as with fasteners 134, pins, clips, etc., to facilitate the use of different profiles with the fuel pump 102. The base portion 131 and the governor arm interface portion 132 of the fuel plate 130 can be of any suitable shape or configuration to facilitate interfacing and/or coupling with one another.

The various components of the adjustable fuel plate device 101 disclosed herein can comprise any suitable material or combination of materials (e.g., metal, polymer, composite, etc.) that can facilitate adequate operation of the respective component at a range of temperatures that may be experienced by the component during use of the device, such as cold ambient temperatures at engine start-up and hot temperatures generated by the engine. In one example embodiment, the support member 110 can be constructed of aluminum and the lead screw 141 and the fuel plate 130 can be constructed of steel.

Figure 6:
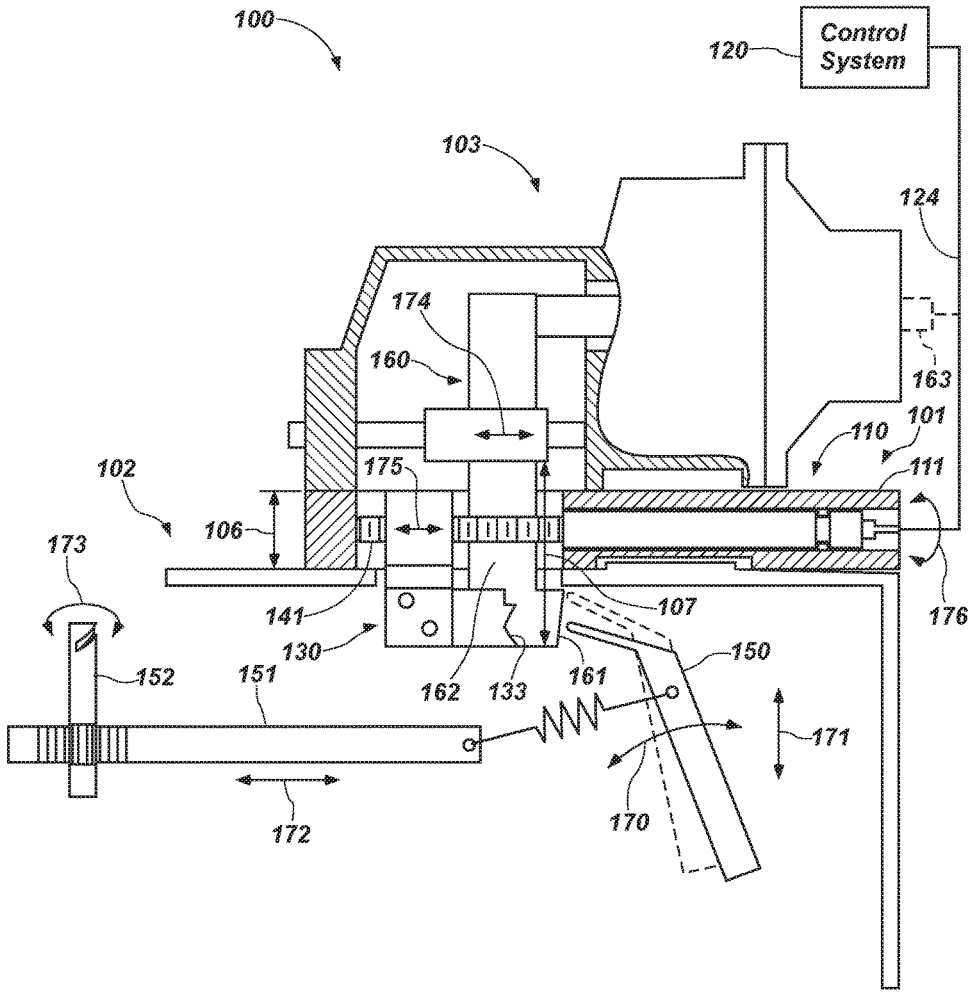
FIG. 6 is a schematic diagram of the diesel fuel pump system of FIG. 1.

With further reference to FIGS. 1-4, FIG. 6 shows a schematic diagram of the diesel fuel pump system 100 of FIG. 1. FIG. 6 schematically illustrates the diesel fuel pump 102 as a typical diesel fuel pump, such as a BOSCH® P series pump (commonly known as a "P-pump"), which may be included in the system and operational with the adjustable fuel plate device. The operation of such fuel pumps is well-known in the art, therefore a detailed explanation will not be provided here. In general, the fuel pump 102 includes a governor arm 150, a rack 151, and a plunger 152. The governor arm 150 is movable in direction 170 as a result of the throttle or accelerator pedal position, where a rightward position corresponds to a closed throttle and a leftward position corresponds to an open throttle. The governor arm 150 is also movable in direction 171 based on the engine speed (RPM), where a lower position corresponds to low RPM and a higher position corresponds to high RPM. The governor arm 150 is coupled to the rack 151, which is movable in direction 172 by the governor arm. The rack 151 is coupled to the plunger 152 to cause the plunger to rotate in direction 173. The plunger 152 is also configured to move in direction 171 by a camshaft (not shown). Such movement of the plunger 152, however, is not relevant in the context of the present disclosure.

The AFC 103 includes an arm 160 that has a governor interface feature 161. In operation, the AFC arm 160 is movable in direction 174 in proportion to pressure from a turbo for the engine. The governor interface feature 161 of the AFC arm 160 serves to limit the range of motion of the governor arm 150 in direction 170 based on the amount of "boost" in the turbo, which in turn limits the range of motion of the rack 151 to the left in direction 172, thereby limiting the amount of fuel that is available to the engine as a result of the rotational position of the plunger 152. This fuel flow control by the AFC 103 can prevent or limit the amount of black smoke discharged from the exhaust. When the boost in the turbo is sufficient, such as at wide open throttle, the AFC arm 160 will move to the left sufficiently to expose the governor interface feature 133 of the fuel plate 130 to the governor arm 150, thus causing the fuel plate 130 to limit the rotational travel of the governor arm 150 to the left in direction 170. As engine speed increases, the governor arm 150 will "ride up" the governor interface feature 133 of the fuel plate. In one aspect, pressure from the turbo to the AFC 103 can be regulated by the control system 120, such as via a flow and/or pressure regulator 163, to control the movement of the AFC arm 160 and therefore vary or change range of motion limits of the governor arm 150.

Figure 7A:
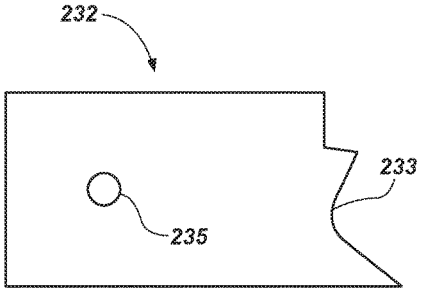
FIGS. 7A-7D illustrate governor arm interface portions of fuel plates having various profiles, in accordance with several examples of the present disclosure.
Figure 7B:
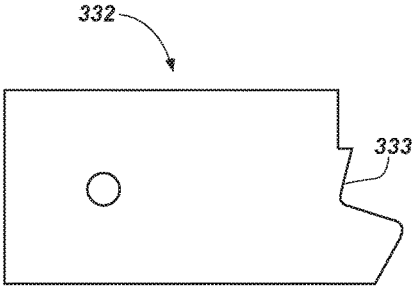
Figure 7C:
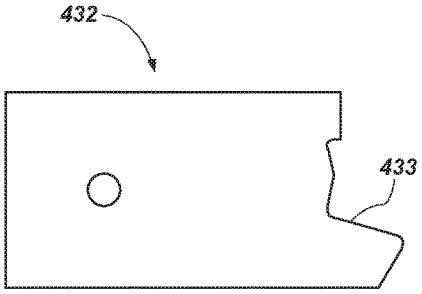
Figure 7D:
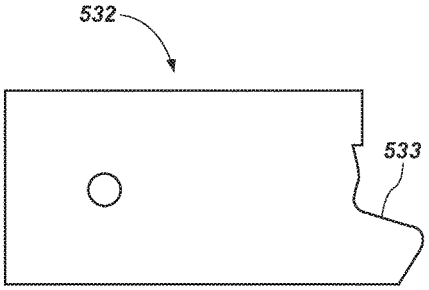

It is well-known that the profile of the fuel plate governor interface feature 133 can have an impact on the power available from the engine. Various specific profiles of the governor interface feature 133 are used to influence the performance of the engine by strategically limiting the amount of fuel available as engine speed varies. FIGS. 7A-7D illustrate several examples of governor arm interface portions of fuel plates, with each governor arm interface portion having a different profile defined by the governor interface features of the fuel plates. For example, a governor arm interface portion 232 shown in FIG. 7A can have a governor interface feature 233 that defines a profile often referred to as a "10", a governor arm interface portion 332 shown in FIG. 7B can have a governor interface feature 333 that defines a profile often referred to as an "8", a governor arm interface portion 432 shown in FIG. 7C can have a governor interface feature 433 that defines a profile often referred to as a "5", and a governor arm interface portion 532 shown in FIG. 7D can have a governor interface feature 533 that defines a profile often referred to as a "6". These governor interface feature profiles are just several examples of fuel plate profiles, as other profile designs can be used as well. A fuel plate can have any suitable governor interface feature profile. A governor arm interface portion can be replaced and exchanged for another governor arm interface portion with a different profile, as desired. For example, as shown in FIG. 7A, the governor arm interface portion 232 can include a coupling feature 235 (e.g., a hole or opening) to facilitate removably coupling the governor arm interface portion to a base portion of a fuel plate, as described herein, such as with a fastener, pin, clip, etc. A governor arm interface portion can therefore be selected with a profile that is suitable for a particular style of driving or to achieve a desired type of performance from the engine (e.g., economy or high power).

Referring further to FIG. 6, with the present technology, the available power can be increased and/or decreased by using a suitable profile, and the power or fuel economy can be regulated as desired by adjusting the position of the fuel plate 130 (e.g., by rotating the lead screw 141 in direction 176). For example, moving the fuel plate 130 in direction 175 can change the boost or pressure level in the turbo at which the fuel plate 130 becomes limiting to the movement of the governor arm 150. Thus, the fuel plate 130 can be moved to the left in direction 175, such that the fuel plate 130 is limiting at higher levels of turbo boost, which allows for a greater amount of fuel to be delivered to the engine for high performance (e.g., high horse power) applications. On the other hand, the fuel plate 130 can be moved to the right in direction 175, such that the fuel plate 130 is limiting at lower levels of turbo boost, which restricts the amount of fuel that can be delivered to the engine for improved fuel economy (with reduced power).

One advantage of the present technology is the ability to move the fuel plate 130 while the engine is operating, such as by using the control system 120, which may have a user interface available to a driver in the cab of the vehicle. Another advantage of the present technology is that the AFC 103 remains fully functional, thus preserving important drivability aspects (i.e., limiting black smoke) provided by the AFC.

It should be noted that the presence of the adjustable fuel plate assembly 110 between the AFC 103 and the fuel pump 102 increases the distance between these two components by a thickness 106 of the support member 111. Thus, a length 107 of a lower portion 162 of the AFC arm 160 can be increased by a length equal to the thickness 106 to properly position the governor interface feature 161 of the AFC arm 160.

In one aspect, an adjustable fuel plate kit for modifying a diesel fuel pump is provided. The kit can include the adjustable fuel plate assembly 110, which can include the support member 111, the fuel plate 130, and the translation mechanism 140, as discussed above. The kit can also include the control system 120, which can be coupleable to the translation mechanism 140 to control movement of the fuel plate 130 during operation of the engine. In addition, the kit can include a replacement AFC arm (such as AFC arm 160) to replace an original AFC arm of the AFC. The replacement AFC arm can be configured to extend into the diesel fuel pump to facilitate operation of the AFC with the diesel fuel pump.

Furthermore, in accordance with one embodiment of the present disclosure, a method for facilitating adjustment of a fuel plate of a diesel fuel pump is disclosed. The method can include providing an adjustable fuel plate assembly to be disposed between a diesel fuel pump for a diesel engine and an AFC, the adjustable fuel plate assembly including a support member having an opening, a fuel plate disposed at least partially in the opening to limit travel of a governor arm of the diesel fuel pump, and a translation mechanism to move the fuel plate relative to the governor arm. The method can also include facilitating operation of the AFC with the diesel fuel pump. In one aspect of the method, facilitating operation of the AFC with the diesel fuel pump includes configuring the opening of the support member to receive an AFC arm therethrough. In another aspect of the method, facilitating operation of the AFC with the diesel fuel pump includes providing an AFC arm configured to extend through the opening of the support member and into the diesel fuel pump. In one aspect, the method can further include facilitating controlling movement of the fuel plate during operation of the engine.

In accordance with another embodiment of the present disclosure, a method for modulating fuel conservation of a diesel engine during operation of the engine can include providing a translation mechanism to move a fuel plate of a diesel fuel pump relative to a governor arm of the fuel pump, the fuel plate being configured to limit travel of the governor arm; and facilitating operation of the translation mechanism during operation of the engine, wherein the translation mechanism is operable to move the fuel plate from a first position to a second position, thereby altering the fuel consumption of the diesel engine. In one example, the second position can be more limiting of governor arm movement than the first position, thereby providing improved fuel efficiency. In another example, the first position can be more limiting of governor arm movement than the second position, thereby providing improved diesel engine performance. In one aspect of the method, the fuel plate can have a profile configured to improve fuel economy. In another aspect of the method, the translation mechanism can comprise a linear actuator. In one aspect, the method can further comprise facilitating control of the translation mechanism from a cab of a vehicle.

In accordance with another embodiment of the present disclosure, a method for modulating fuel consumption of a diesel engine during operation of the engine can include providing a control system to variably limit travel of a governor arm of a diesel fuel pump; and facilitating control of the governor arm travel by the control system during operation of the diesel engine, wherein a travel limit of the governor arm is changed from a first limit position to a second limit position, thereby altering the fuel consumption. In one example, the second limit position can be more limiting of governor arm movement than the first limit position, thereby providing improved fuel efficiency. In another example, the first limit position can be more limiting of governor arm movement than the second limit position, thereby providing improved performance. In one aspect, the method can further comprise facilitating operation of the control system by a driver of a vehicle that includes the diesel engine. In another aspect, the method can further comprise providing a translation mechanism to move a fuel plate of the diesel fuel pump relative to the governor arm, the fuel plate being configured to limit travel of the governor arm, wherein facilitating control of the governor arm travel by the control system comprises facilitating control of the translation mechanism by the control system to move the fuel plate from the first limit position to the second limit position.

It is noted that no specific order is required in the methods disclosed herein, though generally in some embodiments, the method steps can be carried out sequentially.

EXAMPLE

Fuel Flow Results

A Bosch® P-7100 911 fuel injection pump with 191 delivery valves, 4000 RPM governor springs, and rack cap (allowing full rack travel) was used with an adjustable fuel plate device shown in the FIGS. in accordance with the present disclosure, with no aneroid fuel control (AFC). The fuel plate was moved through 20 positions. In one example, movement can be by a mechanical control system, e.g., a mechanical dial and gear mechanism such as that shown in FIG. 5 in combination with a control cable. The following table shows the volume of fuel flow (in cc) per 1000 strokes. End of rack travel was achieved at Position 19.

| Fuel Plate Position | Volume of Fuel Flow (cc/1000 strokes) |
|---|---|
| 1 | 45 |
| 2 | 50 |
| 3 | 56 |
| 4 | 72 |
| 5 | 80 |
| 6 | 102 |
| 7 | 119 |
| 8 | 123 |
| 9 | 152 |
| 10 | 184 |
| 11 | 212 |
| 12 | 240 |
| 13 | 281 |
| 14 | 304 |
| 15 | 320 |
| 16 | 358 |
| 17 | 392 |
| 18 | 426 |
| 19 | 449 |
| 20 | 449 |

It is to be understood that the embodiments of the technology disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting. Additionally, the foregoing example is illustrative of the principles of the present technology in one or more particular applications, it will be apparent to those of ordinary skill in the art that numerous modifications in form, usage and details of implementation can be made without the exercise of inventive faculty, and without departing from the principles and concepts of the disclosure. Accordingly, it is not intended that the technology be limited, except as by the claims set forth below.

What is claimed is:

1. An adjustable fuel plate device for a diesel fuel pump, comprising:

a fuel plate to limit travel of a governor arm of a diesel fuel pump for a diesel engine, the fuel plate having a governor interface surface operable to slidingly engage with the governor arm, the governor interface surface having a profile configured to control fuel delivery by the fuel pump as engine speed varies based on a position of the governor arm along the profile;

a translation mechanism including a linear actuator to move the fuel plate relative to the governor arm; and a control system coupleable to the translation mechanism to control movement of the fuel plate during operation of the engine, wherein the control system comprises a user interface reachable by a driver of a vehicle which includes the diesel engine.

2. The adjustable fuel plate device of claim 1, wherein the fuel plate comprises a removable governor arm interface portion.

3. The adjustable fuel plate device of claim 1, wherein the linear actuator comprises a lead screw.

4. The adjustable fuel plate device of claim 1, wherein the linear actuator comprises a pneumatic or a hydraulic actuator.

5. The adjustable fuel plate device of claim 1, wherein control system further comprises a mechanical coupling for mechanically interfacing the user interface with the fuel plate, the mechanical coupling comprising a member selected from a cable, a gear mechanism, or a combination thereof.

6. The adjustable fuel plate device of claim 1, further comprising a support member in support of the translation mechanism, wherein the support member comprises an opening extending therethrough that receives at least a portion of the fuel plate and facilitates movement of the fuel plate.

7. The adjustable fuel plate device of claim 6, wherein the opening is configured to receive an aneroid fuel control (AFC) arm therethrough and facilitate operation of an AFC with the diesel fuel pump.

8. The adjustable fuel plate device of claim 1, further comprising a support member in support of the translation mechanism, wherein the support member is configured to interface with a fuel pump housing and an aneroid fuel control (AFC) housing.

9. An adjustable fuel plate assembly for a diesel fuel pump, comprising:

a support member having an opening;

a fuel plate disposed at least partially in the opening to limit travel of a governor arm of a diesel fuel pump for a diesel engine; and a translation mechanism to move the fuel plate relative to the governor arm, wherein the opening is configured to receive an aneroid fuel control (AFC) arm therethrough and facilitate operation of an AFC, along with the adjustable fuel plate assembly, with the diesel fuel pump.

10. The adjustable fuel plate assembly of claim 9, further comprising a control system coupled to the translation mechanism to control movement of the fuel plate during operation of the engine.

11. The adjustable fuel plate assembly of claim 9, wherein the translation mechanism comprises a linear actuator.

12. The adjustable fuel plate assembly of claim 11, wherein the linear actuator comprises a lead screw, a hydraulic actuator, a pneumatic actuator, or a combination thereof.

13. An adjustable fuel plate kit for modifying a diesel fuel pump, comprising:

the adjustable fuel plate assembly of claim 9 to be disposed between a diesel fuel pump for a diesel engine and the AFC;

a control system coupleable to the translation mechanism to control movement of the fuel plate during operation of the engine; and a replacement AFC arm to replace an original AFC arm of the AFC, wherein the opening of the support member is configured to receive the AFC arm therethrough and the replacement AFC arm is configured to extend into the diesel fuel pump to facilitate operation of the AFC with the diesel fuel pump.

14. A diesel fuel pump system, comprising:

a diesel fuel pump for a diesel engine;

an aneroid fuel control (AFC); and an adjustable fuel plate device disposed between the diesel fuel pump and the AFC, the adjustable fuel plate device, including:

a fuel plate to limit travel of a governor arm of the diesel fuel pump, a translation mechanism to move the fuel plate relative to the governor arm, and a control system coupled to the translation mechanism to control movement of the fuel plate during operation of the engine.

15. The system of claim 14, wherein the adjustable fuel plate device comprises a support member in support of the translation mechanism.

16. The system of claim 15, wherein the support member comprises an opening extending therethrough that receives a least a portion of the fuel plate and facilitates movement of the fuel plate.

17. The system of claim 16, wherein the AFC comprises an arm, and wherein the opening is configured to receive the arm therethrough and facilitate operation of an AFC with the diesel fuel pump.

18. The system of claim 14, wherein the fuel plate comprises a governor interface surface operable to slidingly engage with the governor arm, the governor interface surface having a profile configured to control fuel delivery by the fuel pump as engine speed varies based on a position of the governor arm along the profile.

19. The system of claim 14, wherein the governor arm is movable in rotational and translational degrees of freedom.

20. The system of claim 14, wherein the diesel fuel pump is a P pump.

21. The adjustable fuel plate assembly of claim 9, wherein the fuel plate comprises a governor interface surface operable to slidingly engage with the governor arm, the governor interface surface having a profile configured to control fuel delivery by the fuel pump as engine speed varies based on a position of the governor arm along the profile.

* * * * *